United States Patent [19]

Stewart-Cox et al.

[11] Patent Number: 4,599,699

[45] Date of Patent: Jul. 8, 1986

[54] CIGARETTE MANUFACTURING MACHINES

[75] Inventors: Adrian R. Stewart-Cox, Eastleigh; Robert G. Bryant, Totton, both of England

[73] Assignee: British-American Tobacco Company Limited, London, England

[21] Appl. No.: 498,795

[22] Filed: May 27, 1983

[30] Foreign Application Priority Data

Jun. 1, 1982 [GB] United Kingdom ..... 8215877

[51] Int. Cl.[4] ..... G06F 11/22; G06F 15/36

[52] U.S. Cl. ..... 364/552; 131/280

[58] Field of Search ..... 364/551, 552; 131/280, 131/64.1, 66.1

[56] References Cited

U.S. PATENT DOCUMENTS

| | | | |
|---|---|---|---|
| 3,720,815 | 3/1973 | Lorenzen | 364/552 X |
| 3,793,512 | 2/1974 | Lorenzen | 364/552 X |
| 3,946,212 | 3/1976 | Nakao et al. | 364/552 |
| 4,280,187 | 7/1981 | Reuland et al. | 264/552 |

FOREIGN PATENT DOCUMENTS

| | | |
|---|---|---|
| 1020481 | 2/1966 | United Kingdom . |
| 1498372 | 1/1978 | United Kingdom . |
| 2083258 | 3/1982 | United Kingdom . |
| 2089081 | 6/1982 | United Kingdom . |

*Primary Examiner*—Felix D. Gruber
*Assistant Examiner*—H. R. Herndon
*Attorney, Agent, or Firm*—Kane, Dalsimer, Kane, Sullivan and Kurucz

[57] ABSTRACT

A method is provided for monitoring cigarette manufacturing machinery in order to provide the machine minder with automatically displayed messages relating to process fault or deterioration conditions before these have led to out-of-specification product or machine stoppage. Other messages relate to machine stoppage causes. The messages result from a comparison routine between the profiles of sets of sampled process condition variables and predetermined profiles of the sets.

19 Claims, 2 Drawing Figures

CIGARETTE MANUFACTURING MACHINES

BACKGROUND OF THE INVENTION

This invention relates to the monitoring of the operation of cigarette manufacturing machines.

A proposal for a method of monitoring the operation of tobacco industry machinery is set forth in United Kingdom Patent Specification No. 1,352,941, the object of the method being to provide management with the extent of machine down-time associated with the or each machine fault responsible for machine stoppage. Sensors are used to detect the occurrence of particular machine operation events and when an event occurs it activates the relevant sensor, which thereby emits a signal which signal in turn causes a cessation of the machine drive and thus a stoppage of the machine. Signals are also sent to a counting device and a time measuring device, there being one of each of these devices associated with each of the sensors. At the commencement of a machine stoppage occasioned by a sensed machine operation event, the count of the counting device associated with the activated sensor is increased by one and the associated time measuring device is activated and remains activated until the machine minder, having remedied the machine fault which has led to the stoppage, has restarted the machine and brought it back up to full production speed. If the same event recurs, the count of the counting device is increased by one and the elapsed time of the stoppage measured by the time measuring device is cummulated with the time value recorded up to the end of the preceding stoppage.

SUMMARY OF THE INVENTION

Another proposal for a method of monitoring tobacco industry machines is one described in United Kingdom Patent Specification No. 1,352,942, the method comprising measuring the rate of input of a commodity into a machine, measuring the rate of output of the commodity in non-reject product and automatically computing a ratio of the two rates. Such ratio is an indicator of the efficiency of operation of the machine.

In United Kingdom Patent Specification No. 2,031,263A there is disclosed a method of identifying malfunctioning components of tobacco industry machinery by monitoring the products of the machinery in accordance with a technique known as periodic analysis. The method rests on a direct causative relationship between a monitored characteristic of the product and a malfunction of a specific machine component. Thus, for example, if in a filter tipping machine comprising a number of sequentially arranged fluted drum conveyors, the number of flutes on each conveyor being different from the number of flutes on all of the other conveyors, a particular flute on one of the conveyors becomes fouled with tipping adhesive, a monitoring of the product cigarettes by way of testing the ventilation level of each cigarette will exhibit a periodic variance enabling the conveyor in question to be identified.

The present invention provides a method of monitoring process conditions of a cigarette manufacturing machine, wherein during periods between stoppages of said machine signals indicative of a number of process condition variables, each of which can have a normal or a non-normal status, are received by programmable process analyzer means, a comparison is made by said analyzer means of the statuses of sets of the received signals with predetermined respective profiles of statuses for the said sets, which profiles contain at least some non-normal statuses, a matching of the actual statuses of one of said sets with the associated profile being indicative of the existence of a process fault condition, and a message indicative of said condition is caused by the said process analyzer means to be displayed at display means upon the occurrence of a said matching.

The present invention further provides a monitoring system comprising programmable process analyzer means and display means, wherein said process analyzer means is operable to receive, during periods between stoppages of a cigarette manufacturing machine, signals indicative of a number of process condition variables, each of which can have a normal or a non-normal status, to make comparisons of the statuses of sets of said signals with predetermined respective profiles of statuses for the said sets, which profiles contain at least some non-normal statuses, a matching of the actual statuses of one of said sets with the associated profile being indicative of the existence of a process fault condition, and to cause a fault message indicative of said condition to be displayed by said display means upon the occurrence of a said matching.

A process condition variable may relate to a machine operation feature or to a feature of a material or of the product. It may be directly determined or may be the result of manipulation of a plurality of signals received over a period of time from a particular sensor mounted at the cigarette manufacturing machine. For example, an arithmetic mean or a standard deviation may be calculated. A process condition variable may also be derived from a calculation involving signals from a plurality of sensors. A simple example of the last mentioned type of variable is a ratio.

The comparison procedure performed by the process analyzer may comprise stoppage analysis, in which case the message displayed at the display means is a stoppage message, that is to say a message indicative of the causal process event, or likely such event. In this case the profile for the set of process condition variables may be one determined not only by the constituent statuses, but also by the order of occurrence of the assumption of the specified status for each of the process condition variables and/or the separations in time of the assumptions of the specified statuses.

The comparison procedure may also comprise process condition analysis. Process condition analysis results in the display of a process condition message relating to a deviation in machine performance. For the purposes of process condition analysis the profile for the set of process condition variables is determined only by the constituent statuses. Order or separation in time do not form aspects of the profile.

Information of value to the machine minder, i.e. operative or mechanic, may at least in some cases be derivable from the occurrence of a partial profile match in a stoppage analysis or a process condition analysis.

The cigarette manufacturing machine may be a rod-making machine operable to make cigarette rod, that is to say rod comprising a smoking material wrapped in a paper wrapper, or it may be a rod-making machine operable to make filter rod, that is to say rod comprising filtration material which is wrapped in a paper or other wrapper, commonly referred to as plugwrap, or alternatively is of a self-sustaining character. If the machine is a filter rod making machine it may be operable to make filter rod intended to provide, by severance at appropriate locations of the rod, so-called dual or triple filters.

The cigarette manufacturing machine may also be a filter tipping machine, a cigarette reservoir conveyor such as, for example, a Molins OSCAR, or a cigarette packing/wrapping machine. The invention is relevant to a group of coupled cigarette manufacturing machines, especially a group containing a rod-making machine(s).

Modern rod-making and other cigarette manufacturing machines are equipped with numerous devices which monitor aspects of the machine process and, upon the occurrence of particular machine operation events or the product being outside quality tolerance limits, cause cessation of the machine drive and thus a stoppage of the machine. When a stoppage occurs it is required of the machine minder to identify and remedy the process condition which has led to the stoppage and then to restart the machine.

By use of the present invention a process condition message may be provided to the machine minder thus to enable the minder to remedy a process fault condition with a minimal production of out-of-specification rod product or, if a machine stoppage has occurred, to be speedily apprised of the causal process condition. Thus it may be said that by use of the present invention the machine minder is enabled to participate in a quick response, open loop control system. This is in sharp contradistinction to prior proposed systems operating merely to provide accumulated process data for examination by management and by way of which management may be apprised on a comparatively long time scale of the existence of a process condition which requires attention.

Use of the present invention permits the attainment of uptime periods of longer duration and the production of product to higher qu standards.

BRIEF DESCRIPTION OF THE DRAWINGS

In order that the invention may be clearly understood and readily carried into effect, reference will now be made, by way of example, to the accompanying drawings, in which.

DETAILED DESCRIPTION OF THE PREFERRED EMBODIMENT

Figure 1:
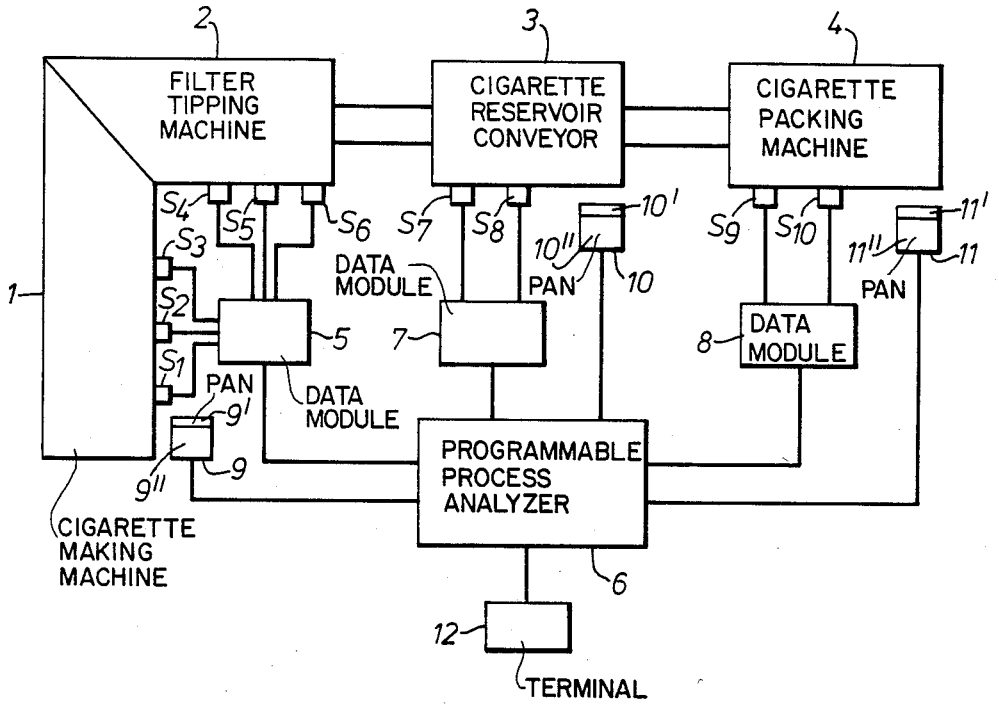
FIG. 1 shows a schematic of a machine group and associated monitoring apparatus.

The machine group shown in FIG. 1 comprises four coupled units, namely a cigarette making machine 1, a filter tipping machine 2, a cigarette reservoir conveyor 3 and a cigarette packing machine 4. The cigarette making machine 1 could, for example, be that manufactured by Molins Limited under the designation "Mark 9.5".

Numerous sensors are mounted on the units 1–4 of the machine group. These are represented in FIG. 1 by sensors $S_1$–$S_3$ associated with the cigarette making machine 1, sensors $S_4$–$S_6$ associated with the filter tipping machine 2, sensors $S_7$ and $S_8$ associated with the cigarette reservoir conveyor 3 and sensors $S_9$ and $S_{10}$ associated with the cigarette packing machine 4. In practice it is likely that there would be far more than ten sensors associated with the machine group. The sensors $S_1$–$S_6$ are connected to a data acquisition module 5, which in turn is connected to a programmable process analyzer 6. Similarly, the sensors $S_7$ and $S_8$ are connected to a data acquisition module 7 and the sensors $S_9$ and $S_{10}$ are connected to a data acquisition module 8, the module 7 and the module 8 having respective connections with the process analyzer 6. Each of the data acquisition modules 5, 7 and 8 is micro processor based and has an input/output unit capable of fast data transfer.

At convenient locations in vicinities respectively of the cigarette making machine 1, the cigarette reservoir conveyor 3 and the cigarette packing machine 4 are communications panel units 9, 10 and 11. Each of the panel units 9, 10 and 11 is connected with the process analyzer 6 and each comprises a display module (9', 10', 11') and a request button module (9'', 10'', 11''). The display modules 9', 10', 11' are capable of displaying messages relating to the operation of the machine group, the displays being shown either automatically under the command of the process analyzer 6 or in response to an enquiry entered at one of the request button modules 9'', 10'', 11'' by the machine minder. Each of the display modules 9', 10', 11' comprises a headline display consisting of 32 characters and being readable from a distance of 5 meters, and a page display of twelve lines each of 40 characters readable at 2 meters.

A production terminal 12 is provided for the purpose of enabling supervisory personnel to input data, product and process parameters for example.

The sensors, as represented by sensors $S_1$–$S_{10}$, the data acquisition modules 5, 7 and 8, the process analyzer 6 and the communication panel units 9–11 constitute a monitoring system which functions to assist the machine minder by providing simple word messages indicative of fault conditions, the messages being displayed at the display modules 9', 10', 11'. The monitoring system operates on a stand alone basis in the sense that, once the requisite initialisation data have been entered by supervisory management via the production terminal 12, no input is required of the machine minder in order for the system to function. Furthermore, it may be arranged, if required, that the machine group can operate with the monitoring system in a non-operative condition.

Those sensors which are fitted to the machines 1–4 of the machine group and which function to cause machine stoppage upon the occurrence of particular process events are generally speaking sensors with which the machines would be fitted as standard. These sensors, which may be termed "stoppage sensors" do not form part of the monitoring system and are not indicated in FIG. 1, but the stoppage sensors are nevertheless connected with the monitoring system such that when a stoppage sensor becomes activated a stoppage signal is fed to the monitoring system.

The monitoring system is operable to display, at the display modules 9', 10', 11' of the communication panel units 9, 10, 11, stoppage messages and process condition messages. When a machine stoppage occurs there is displayed a message indicative of the location of the causal process event or likely such event. The appropriate form of stoppage message is selected by the process analyzer 6 as a result of a stoppage analysis which is performed by the process analyzer 6. When the machine group is running, process condition messages are displayed as a result of a process condition analysis procedure which is also performed by the process analyzer 6. Further details of the stoppage and process condition analysis procedures are given hereinafter.

When a machine stoppage occurs the causal process event gives rise, in the case of most such events, to a chain of consequential events some at least of which will activate sensors of the monitoring system, i.e. the statuses of the process condition variables will be determined by the sensors to have changed from "normal" to "non-normal". Thus a number of digital input signals enter the relevant one of the data acquisition modules 5, 7 or 8. These signals are usually separated in time by fractions of a second, sometimes a few milliseconds. The terminating event is the opening of the main drive contactor, which results in the machine stoppage. The opening of the main drive contactor is caused either by the activation of a stoppage sensor or by the machine minder pressing a stop button.

The digital signals are stored in the data acquisition module in a 20 second cyclic store and thus when the machine stoppage is signalled there is available for stoppage analysis in the process analyzer 6 a time organised signal string, the signals of which relate to events, i.e. assumptions of non-normal status by process condition variables, which have occurred within a period of up to 20 seconds long. Receipt by the data acquisition module of a stoppage signal terminates storage of active digital signals and thus a stoppage signal will always be the last signal in a string.

Examples of process events at the maker 1/tipper 2 which may give rise to the sensor generated digital signals are given below.

Chimney choke top
Chimney choke bottom
Tobacco loss at suction band
Seal flap choke
Tongue choke
Paper edge misplaced
Open rod seam
Paper splice fault
Rod lightweight
Rod break
Missing filter plug at plug hopper
Rolling plate jam
Tipping paper break In the analysis of a machine stoppage signal string to determine the causal process event, the order of the signals as well as the event signification of each signal must be examined. In order to interpret a signal string in relation to profiles of process condition variables in which both the order and the signification aspects are of account, the string is tested in the process analyzer 6 by means of an algorithm based, for example, on a symbol-state table. Some event signals are designated "prime event signals". These are signals relating to events which can be taken to be causal events. Prime event signals usually, but not always, occur first in a stoppage signal string. There are cases, though comparatively rare, in which the time between events is of significance in determining the cause of machine stoppage. Such cases are dealt with by resort to a time algorithm.

At completion of the stoppage analysis the process analyzer 6 causes the relevant stoppage message to be displayed at the headline display of the relevant one of the display modules 9', 10', 11'. The event signification of each of the signals in the stoppage string may be displayed on the page display of the display module.

Examples of stoppage cause messages relating to the maker 1/tipper 2 are given below.

BLOCKAGE IN RAILS
CHOKE AT CHIMNEY-TOP
CHOKE AT CHIMNEY-BOTTOM
CHOKE AT ECRETEURS
CHOKE AT TONGUE
SUSPECTED CHOKE AT TONGUE
PAPER SPLICE FAILURE
PAPER EDGE MISPLACED - HIGH
TIPPING PAPER SPLICE FAILURE
GEARBOX OIL PRESSURE LOW

Examples of the stoppage cause messages relating to the reservoir 3/packer 4 are as follows.

RESERVOIR CLUTCH OUT
RESERVOIR EMPTY
MISSING CIGARETTE IN BUNDLE
MISSING INNER FRAME
BLANK SKEWED OR MISSING
BLANK FEED BLOCKED
PLOUGH FOLD JAM
BROKEN PACKET (SEALER)
TEAR STRIP BROKEN
WRAPPER FILM BROKEN

When a stoppage has occurred and after the machine minder has remedied the cause condition of the stoppage and initiated a restart procedure, the storage of active digital signals is not resumed until in the case of the cigarette making machine 1 a cigarette counting sensor, sensor $S_3$ say, indicates the attainment of 90% full production speed or until, in the case of the packer 4 a predetermined number of packets have passed a packet counting sensor, sensor $S_{10}$ say.

As mentioned above, the monitoring system is operable to perform process condition analysis during periods when the machine group is running, i.e. between machine stoppages. If as a result of the carrying out of the process condition analysis procedure there is detected a deviation from a normal state or optimum value of an aspect of machine performance or of product quality, a process condition message will be displayed at the page display of the relevant one of the display modules 9', 10', 11'. The machine minder is in this way provided with indications of the onset and continuance of process fault or deterioration conditions before these have developed to an extent which leads to the production of out-of-specification product and/or machine stoppage. Tolerance values or threshold limits the exceeding of which determines the establishment of a deviation condition may be entered into the proces by analyzer 6 by way of the production terminal 12.

Because of the presence in the machine group of the cigarette reservoir conveyor 3, for limited periods of stoppage of one of the maker 1/tipper 2 and the packer 4, the other can continue to operate and will, unless the limited period is exceeded, continue to be the subject of process condition analysis. It may be noted in this regard that the machine group could include other reservoirs, as for example one between the maker 1 and the tipper 2.

A part of the input to the process condition analysis procedure takes the form of a number, two hundred for example, of process condition variables, signals indicative of the values of which are fed from the data acquisition modules 5, 7 and 8 to a buffer memory store of the process analyzer 6. These signals are derived by the data acquisition modules 5, 7 and 8 either directly from primary signals, usually analogue but in some cases digital, emitted by certain of the sensors exemplified by sensors $S_1$–$S_{10}$ in FIG. 1, or by manipulation of such primary signals to give signals indicative of mean values, standard deviations, means of groups, standard deviations of groups, and various rate values. The data acquisition modules sample the analogue inputs at sample rates which are not necessarily the same for all sensors. Thus, for example, paper edge position might be sampled every 7.5 milliseconds, paper tension every 100 milliseconds and ecreteur displacement every second.

The remaining part of the input to the process condition analysis procedure takes the form of process condition signals indicative of rates, in time or in events, derived in the process analyzer 6 from stoppage cause signals produced from the stoppage analysis procedure.

Definitions of the above mentioned statistical terms are as follows.

MEAN: The arithmetic mean of the last a values read from an analogue input at the specified acquisition rate, updated every b values.

S.D.: The standard deviation of values of a MEAN.

RANGE: The highest minus the lowest of c values used to calculate a MEAN.

MEAN OF GROUPS: The arithmetic mean of the last d MEAN values, updated every e values.

S.D. OF GROUPS: The standard deviation of values of MEAN OF GROUPS.

ALARM INDEX: An index of whether or not the elapsed time f between the most recent occurrence of a stoppage cause and the current time is greater or less than g seconds.

The values of a–g may be entered through and varied by means of the production terminal 12. Suitably, a=b and d=e.

Examples of process condition variables are as follows.

Paper edge position MEAN
Paper edge position S.D.
Paper edge position RANGE
Paper edge position GROUP MEAN
Paper edge position GROUP S.D.
Tobacco rod circumference MEAN
Tobacco rod circumference S.D.
Tobacco rod circumference RANGE
Tobacco rod circumference GROUP MEAN
Tobacco rod circumference GROUP S.D.
Tobacco hopper drive speed MEAN
Tobacco hopper drive speed S.D.
Tobacco hopper drive speed RANGE
Tobacco hopper drive speed GROUP MEAN
Tobacco hopper drive speed GROUP S.D.
Light cigarette defect rate
Heavy cigarette defect rate
Seal flap choke rate
Open seam rate
Rod breakout at garniture rate
Rolling plate jam rate
Missing filter plug rate
Missing inner frame reject rate Signals inputted to the process condition analysis procedure are smoothed with a view to ensuring that any transient effect on the signals will not unacceptably affect the values of the signals. The smoothing function is carried out in accordance, for example, with the following relationship $$P=\alpha P_o+(1-\alpha)P_n$$

where:

P=Value of process condition variable inputted to the process condition analysis procedure.

$P_o$=Previous value of the process condition variable.

$P_n$=Present value of the process condition variable.

$\alpha$=Smoothing factor, $0\leqq\alpha<1$.

The smoothed process condition variables have ascribed to them an upper and/or lower limit. At any given time each of these variables has a value falling within one of three possible status classifications, namely "high", "normal" or "low".

According to the process condition analysis procedure the status of each of the process condition variables is checked, by the process analyzer 6, at regular intervals of, for example, ten seconds, to ascertain if the status of any of the variables has changed since the next preceding status check. If one or more of the process condition variables has changed status, the process analyzer 6 initiates a comparison routine in order to compare the statuses of sets of the variables with status profiles for the sets. Each of the status profiles relates to a particular process fault or deterioration condition. The status profiles have an upper limit number of variables, twelve for example. If a match is identified between a set of variables and a status profile, a message descriptive of the process condition related to that profile is caused by the process analyzer 6 to be displayed on the page display of the relevant one of the display modules 9', 10', 11'. More than one process message may be displayed on any one of the display modules, either simultaneously or alternately. A process condition message remains active until a subsequent comparison routine reveals it to be no longer valid; it is then cleared.

Examples of process condition messages are given below:

CARDING PROBLEM
WET TOBACCO
DRY TOBACCO
WORN GARNITURE TAPE
TAPE DRUM SLIP
WORN ECRETEUR DISC
DAMAGED SUCTION BAND
MAKER ADHESIVE PROBLEM
DIRTY GARNITURE
HEATER PROBLEM
TONGUE PROBLEM
PACKER ADHESIVE PROBLEM

In some cases if a profile match is detected in the comparison routine excepting for the status of one or more specified process variables of the set, a tentative or qualified process condition message may be caused to be displayed. Thus, for example, the message may be prefixed by the word "suspected" or suffixed by a "?" symbol. An alternative procedure in a partial match situation is for the messages to descend through a hierarchical sequence as additional process variables match the profile, each message narrowing down, over the next preceding message, the process condition area. According to a yet further procedure, when a substantial yet not total profile match is determined, as for example if seven process variables of a set of eight match the profile of the set, an analysis is made in which a probability weighting is applied to the matching variables so as to arrive at a probability of the partial match indicating that the process condition associated with the set does obtain notwithstanding the absence of a total profile match. If the overall probability exceeds a threshold probability it is assumed that the process condition exists and a process condition message is displayed accordingly.

Figure 2:
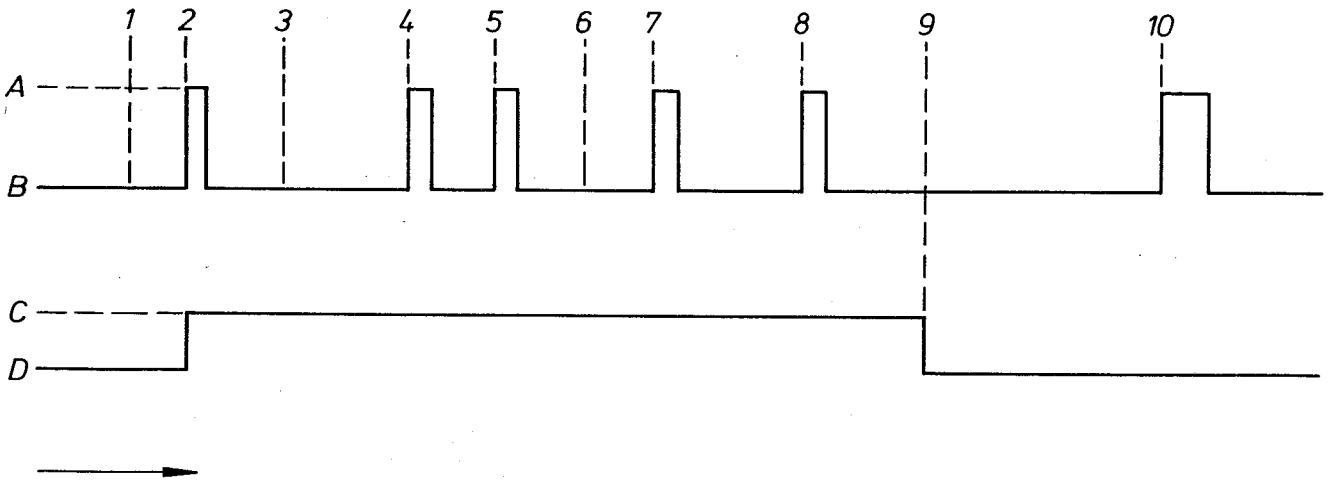
FIG. 2 shows a diagram relating to a sequence of events in the operation of a cigarette maker/tipper.

An example of a sequence of process events on the maker 1/tipper 2 and of the consequent stoppage and process condition messages will now be described with reference to FIG. 2. In the example "P.C.M." means Process Condition Message, "P.C.V." means Process Condition Variable and "S.M." means Stoppage Message. In FIG. 2, level A connotes a stoppage condition, level B a running condition, level C an activated condition of a seal flap blockage index monitor and level D a deactivated condition of the index monitor. The direction of time elapse is indicated by the arrow.

| | | |
|---|---|---|
| TIME 1 | Maker/Tipper is running | |
| | Some but not all P.C.V.s match a profile | |
| | Group mean air cell pressure | high |
| | Group mean chimney flow | high |
| | Group mean paper tension | high |
| | P.C.M. - TOBACCO FEED ALARM CHIMNEY AREA | |
| | P.C.M. - GARNITURE ALARM PAPER FEED AREA | |
| TIME 2 | Maker/Tipper stoppage | |
| | Stoppage string | |
| | Tobacco loss at suction band | |
| | Rod break | |
| | Seal flap blockage | |
| | Chimney choke top | |
| | Machine stop | |
| | S.M. - SEAL FLAP BLOCKAGE | |
| | Seal flap blockage index monitor active | |
| TIME 3 | Maker/Tipper has resumed running | |
| | Additional P.C.V.s match profile | |
| | Group mean air cell pressure | high |
| | Group mean chimney flow | high |
| | Group mean paper tension | high |
| | Heavy cigarette defect rate | high |
| | Seal flap blockage index | high |
| | P.C.M. - TOBACCO FEED ALARM CHIMNEY AREA | |
| | WEIGHT PROBLEM (HEAVY CIGS) | |
| | P.C.M. - GARNITURE AREA PAPER FEED AREA | |
| | Seal flap blockage index monitor still active | |
| TIME 4 | Maker/Tipper stoppage | |
| | Stoppage string | |
| | Rod break | |
| | Tobacco loss at suction band | |
| | Seal flap blockage | |
| | Machine stop | |
| | S.M. - SEAL FLAP BLOCKAGE | |
| | Seal flap blockage rate is excessive, i.e. time elapsed from TIME 2 is not greater than threshold value | |
| TIME 5 | Maker/Tipper stoppage | |
| | Stoppage string | |
| | Paper break | |
| | Rod break | |
| | Machine stop | |
| | S.M. - PAPER BREAK | |
| TIME 6 | Maker/Tipper has resumed running | |
| | Further P.C.V.s match profile | |
| | Group mean air cell pressure | high |
| | Group mean chimney flow | high |
| | Group mean paper tension | high |
| | Group mean tobacco returns | high |
| | Heavy cigarette defect rate | high |
| | Seal flap blockage index | high |
| | Seal flap blockage rate | high |
| | P.C.M. - FEED RATE TOO HIGH | |
| | The status profile for the message FEED RATE TOO HIGH is completed at TIME 6 | |
| TIME 7 | Maker/Tipper stoppage | |
| | Stoppage string as per TIME 4 | |
| | S.M. - SEAL FLAP BLOCKAGE | |
| | P.C.M. - FEED RATE TOO HIGH | |
| TIME 8 | Maker/Tipper stoppage | |
| | Stoppage string | |

-continued

| | |
|---|---|
| | Missing plug |
| | Cork break |
| | Suction jam |
| | Machine stop |
| | S.M. - FILTER BLOCKAGE |
| | exceeded, therefore seal flap blockage index and rate monitors deactivated |
| TIME 9 | Threshold time value from TIME 7 |
| | exceeded, therefore seal flap blockage index and rate monitors deactivated |
| TIME 10 | Maker/Tipper stoppage |
| | Stoppage string as per TIME 5 |
| | S.M. - PAPER BREAK |

In the above sequence of process events the process condition messages change from the tentative messages displayed at Time 1 to the specific message FEED RATE TOO HIGH at Time 7. One of the additional process condition variables enabling the process fault condition to become more closely defined after the display of the tentative message at Time 1 is seal flap blockage rate. It may be noted that the stoppage at Time 5 is not related to the stoppages at Times 2 and 4 and that the stoppage at Time 8 is not related to any prior stoppage in the period of machine operation covered by the illustrative sequence. At Time 7 a process condition message is displayed simultaneously with a related stoppage message. In this case the machine minder is informed not only of the apparently immediate causal event of the stoppage, but also of the causal process condition which led to the stoppage. This is a powerful method to help the machine minder to take appropriate corrective action directly. It reduces the likelihood of the minder taking less constructive action.

It is totally impracticable to provide a cigarette manufacturing machine with such a number of sensors as to be able to monitor directly all components of the machine and the materials operated on by the machine at all points in their paths of travel through the machine. However, by use of the present invention it is possible by employing a limited number of sensors to deduce the nature of an out-of-specification process condition without directly monitoring that condition.

We claim:

1. A method of monitoring the manufacturing process conditions of cigarette manufacturing machinery comprising a rod-making machine, wherein during periods between stoppages of said machinery signals indicative of a number of process condition variables, each of which can have a normal or a non-normal status, are received by programmable process analyzer means, a comparison, comprising stoppage analysis, is made by said analyzer means of sets of the received signals with predetermined respective profiles of signal statuses for the said sets, which profiles contain at least some non-normal signal statuses, a matching of one of said sets with the associated predetermined profile being indicative of the causal process event of a machine stoppage, and a message indicative of said event is caused by the said process analyzer means to be displayed at display means upon the occurrence of a said matching.

2. A method as claimed in claim 1, wherein said message is indicative of the location of said causal process event.

3. A method as claimed in claims 1 or 2, wherein the comparison process carried out by said analyzer means comprises a comparison of the order of receipt by said analyzer means of the signals of a set thereof.

4. A method as claimed in claim 1 or 2, wherein said signals are stored for a predetermined period in a cyclic store, the storage of further signals being discontinued upon the occurrence of a machine stoppage.

5. A method as claimed in claims 1 or 2 wherein the comparision process carried out by said analyzer means comprises a comparison of the order of receipt by said analyzer means of the signals of a set thereof and said signals are stored for a predetermined period in a cyclic store, the storage of further signals being discontinued upon the occurrence of a machine stoppage.

6. A method as claimed in claim 1, wherein the comparison made by said analyzer means comprises process conditon analysis.

7. A method as claimed in claim 6, wherein a process conditon message, indicative of a diviation from an optimum value of a process condition, is displayed during the running of the monitored machinery.

8. A method as claimed in claim 6 or 7, wherein at least some of the signals used in said comparison by said analyzer means are signals derived from statistical analysis of a plurality of primary signals.

9. A method as claimed in claim 6 or 7, wherein each process condition variable is sampled at regular, predetermined intervals.

10. A method as claimed in any one of claims 6 or 7, wherein in input to the process condition analysis comprises process condition signals indicative of a rate value derived from stoppage signals resulting from said stoppage analysis.

11. A method as claimed in any one of claim 6 or 7, wherein the status of each process condition variable is checked by the process analyzer at regular, predetermined intervals and a comparison routine is initiated if the status of a process condition variable is different from the status thereof at the next preceding status check.

12. A method as claimed in any one of claims 6 or 7, wherein if a comparison routine determines there to be a profile match between a set of signals and a predetermined profile for that set, excepting for the status of one or more specified signals of the set, said process analyzer means causes a process condition message to be displayed.

13. A method as claimed in claim 12, wherein said message comprises an indication that it is a tentative message and the comparison made by said analyzer means comprises process condition analysis wherein if a comparison routing determines there to be a profile match between a set of signals and a predetermined profile for that set, excepting for the status of one or more specified signals of the set, said process analyzer means causes a process condition message to be displayed.

14. A method as claimed in claim 13, wherein subsequent process condition messages relating to the set are in accordance with a predetermined hierarchical sequence as additional signals are determined to match the said predetermined profile.

15. A method as claimed in claim 13, wherein an analysis is made by said process analyzer means in which analysis a probability weighting is applied to those process condition variables the signals of which match the said predetermined profile, an overall probability of the existence of the process condition to which the set relates is determined and a comparison is made of the overall probability and a threshold probability, and a process condition message indicative of the existence of said condition is displayed if the overall probability exceeds the threshold probability.

16. A monitoring system comprising programmable process analyzer means and display means, wherein said process analyzer means is operable to receive, during periods between stoppages of cigarette manufacturing machinery, comprising a rod-making machine, signals indicative of a number of process condition variables, each of which can have a normal or a non-normal status, to make comparisons of sets of said signals with predetermined respective profiles for the said sets, which profiles contain at least some non-normal signal statuses, a matching of one of said sets with the associated predetermined profile being indicative of the causal process event appertaining to a machine stoppage, and to cause a message indicative of said event to be displayed by said display means upon the occurrence of a said matching.

17. A system as claimed in claim 16 and comprising one or more data acquistion modules operable to demand signals from sensor means associated with a cigarette manufacturing machine and to transmit signals to said process analyzer means.

18. A system as claimed in claim 17, in which each of said data acquisition modules comprises a cyclic store operable to store signals received over a predetermined period.

19. A system as claim in any one of claim 16, 17 or 18, wherein said process analyzer means is operable to carry out process condition analysis.

* * * * *